US007972117B1

(12) United States Patent
MacDonald

(10) Patent No.: US 7,972,117 B1
(45) Date of Patent: Jul. 5, 2011

(54) PUMP CONTROL SYSTEM FOR SUBMERSIBLE PUMPS

(75) Inventor: Ronald MacDonald, Hemet, CA (US)

(73) Assignee: SEEwater, Inc., San Jacinto, CA (US)

( * ) Notice: Subject to any disclaimer, the term of this patent is extended or adjusted under 35 U.S.C. 154(b) by 902 days.

(21) Appl. No.: 11/501,470

(22) Filed: Aug. 8, 2006

Related U.S. Application Data

(60) Provisional application No. 60/706,731, filed on Aug. 8, 2005.

(51) Int. Cl.
*F04B 49/04* (2006.01)
*F04B 43/12* (2006.01)
*F04B 49/06* (2006.01)

(52) U.S. Cl. ..... 417/40; 417/53; 417/423.3

(58) Field of Classification Search ..... 417/423.3, 417/40, 53, 46; 73/291, 304 C, 305
See application file for complete search history.

(56) References Cited

U.S. PATENT DOCUMENTS 2,798,436 A * 7/1957 Teasdale ..... 417/28
3,758,236 A * 9/1973 Zimmerman ..... 417/360
3,759,634 A * 9/1973 Eskola et al. ..... 417/32
3,941,507 A * 3/1976 Niedermeyer ..... 417/2
3,972,647 A * 8/1976 Niedermeyer ..... 417/2
4,087,204 A * 5/1978 Niedermeyer ..... 417/2
4,230,578 A * 10/1980 Culp et al. ..... 210/86
4,289,451 A * 9/1981 Lewis ..... 417/40
4,586,033 A 4/1986 Andrejasich
4,728,941 A 3/1988 Andrejasich
4,800,372 A 1/1989 Poteet
4,804,936 A 2/1989 Sale
5,049,037 A * 9/1991 Carson et al. ..... 417/36
5,061,157 A * 10/1991 Arakawa ..... 417/423.14
5,205,725 A * 4/1993 Pattison ..... 417/423.3
5,287,086 A 2/1994 Gibb
5,305,779 A 4/1994 Izaguirre
5,463,378 A 10/1995 Gibb
5,628,350 A 5/1997 Gibb
(Continued)

FOREIGN PATENT DOCUMENTS

CA 2292901 6/2001
(Continued)

OTHER PUBLICATIONS

Product Specification of Weil S100K7126 Oil Sensor, Jun. 1, 2003.

*Primary Examiner* — Charles G Freay
*Assistant Examiner* — Peter J Bertheaud
(74) *Attorney, Agent, or Firm* — Knobbe, Martens, Olson & Bear LLP

(57) ABSTRACT

A pump control system for a submersible pump is provided. The system includes a pump controller adapted to activate the pump when water has reached a high threshold level and to deactivate the pump when water has dropped to a low threshold level. The pump controller also incorporates one or more sensing devices that are capable of detecting the presence of a non-conductive fluid in water so that the pump can be deactivated if oil is detected in water. The system further includes an auxiliary control device which is adapted to automatically override the pump controller and de-energizes the pump if the pump remains activated when water drops to a level below the low threshold level.

6 Claims, 4 Drawing Sheets

U.S. PATENT DOCUMENTS 5,765,995 A * 6/1998 Springer ..... 417/40
5,856,783 A * 1/1999 Gibb ..... 340/618
6,203,281 B1 3/2001 Gurega
6,218,948 B1 * 4/2001 Dana ..... 340/604
6,414,598 B2 7/2002 Freill et al.
6,476,723 B1 11/2002 Campbell et al.
6,632,072 B2 * 10/2003 Lipscomb et al. ..... 417/36

FOREIGN PATENT DOCUMENTS

JP 55151240 A2 11/1980

* cited by examiner

| Float level | Pump controller energized? | Auxiliary control |
|---|---|---|
| Above "Low water level" | Yes | On |
| Between Low water leve and Re-energize level | Yes | On |
| Between Re-energize leve and Dry-condition leve | No | Off |
| Below Dry-condition level | No | Off |

PUMP CONTROL SYSTEM FOR SUBMERSIBLE PUMPS

CROSS-REFERENCE TO RELATED APPLICATIONS

This application claims the benefit of priority under 35 U.S.C. §119(e) of U.S. Provisional Application No. 60/706,731, filed Aug. 8, 2005, entitled PUMP CONTROL WITH BACKUP SHUT DOWN SYSTEM, the entirety of which is hereby incorporated herein by reference.

BACKGROUND OF THE INVENTION

1. Field of the Invention

The present invention relates generally to pump control systems, and in particular, relates to a pump control system used in conjunction with submersible pumps in confined areas such as transformer vaults and elevator shafts to remove excess water.

2. Description of the Related Art

Important technological infrastructure, such as electrical hardware and elevator hydraulics and cables, are often located in enclosed spaces such as transformer vaults and elevator shafts. This infrastructure is enclosed for a variety of reasons, including engineering design, prevention of injury or theft, noise dampening, and aesthetics. However, these enclosed spaces are often subject to waste water accumulation as water from rain, irrigation, leaks, and other sources may enter these spaces, accumulate, and flood the enclosure.

To prevent water from rising above a certain level in these enclosed spaces, submersible pumps are often used to remove accumulated water from these locations. The water is typically pumped into a reservoir and ultimately released into the environment via a sewer system or the like. However, the waste water is often mixed with oil that leaked from the equipment in these structures. This oil-water mixture presents an environmental hazard if it is pumped into the sewer system.

Pump controllers are usually used to control the operation of submersible pumps. A pump controller is typically configured to activate the pump when water within the enclosed space has reached a high threshold level and to de-activate the pump when water has dropped below a low threshold level. Additionally, some pump controllers have sensors that are capable of differentiating between oil and water so as to prevent oil from being pumped into the environment. However, pump controllers could sometimes malfunction and cause the pump to continue pumping even if water has dropped below the low threshold level. As a result, the pump could be damaged from running under dry conditions. Therefore, there exists a need for an improved pump control system for submersible pumps adapted for removing waste water from enclosed spaces and reducing the occurrence of the pump running under dry sump conditions.

SUMMARY OF THE INVENTION

In one embodiment of the present invention, the pump control system comprises a pump controller wherein the pump controller is electrically connected to the submersible pump and capable of activating and deactivating the submersible pump. Preferably, the pump controller is adapted to activate the submersible pump when water has reached a first level and to deactivate the submersible pump when water has reached a second level. Preferably, the pump controller incorporates one or more sensing devices that are capable of detecting the presence of a non-conductive fluid in water. The pump control system further comprises an auxiliary control device, wherein the auxiliary control device is adapted to automatically override the pump controller and deactivate the submersible pump if the submersible pump remains activated when water reaches a third level, wherein the third level is below the second level.

In another embodiment of the present invention, a method of controlling the operation of a submersible pump in a confined area comprises detecting the presence of water at a first predetermined level in the confined area, activating the submersible pump via a pump controller if water is detected at the first predetermined level, detecting the presence of oil at a second predetermined level in the confined area, and deactivating the submersible pump via the pump controller if water is detected at the second predetermined level. The method further comprises sensing the presence of water at a third predetermined level in the confined area, and overriding the pump controller and de-energizing the submersible pump if water is detected at the third predetermined level and yet the pump remains activated. Preferably, the third predetermined level is below the first and second predetermined levels.

In yet another embodiment of the present invention, a pump system comprises a submersible pump adapted to remove water from a confined space, a pump controller comprising a sensor capable of differentiating between water and oil, wherein the pump controller is operatively connected to the pump, and an auxiliary control which is adapted to automatically override the pump controller when the pump controller fails to perform one or more preset functions.

In yet another embodiment of the present invention, a pump control system comprises a primary pump controller and an auxiliary shut-down device that is operatively interconnected to the primary pump controller. In one embodiment, the primarily pump controller is capable of sensing and distinguishing between non-conductive and conductive fluids in an enclosed area such as a sump. The primary pump controller can utilize capacitance based sensors, conductivity probes, dielectric sensors, and/or combinations thereof to detect the presence or absence of water and/or oil.

In certain preferred embodiments, the auxiliary shut-down device can comprise a float switch, a pressure switch, or any other types of device that are capable of detecting the presence or absence of a fluid at a predetermined level and communicating the information to a pump controller circuit. In a preferred embodiment, the auxiliary shut-down device is connected to the circuit of the primary pump controller so that when the pump controller fails to deactivate the pump, the auxiliary shut-down device will de-energize the pump controller, which in turn de-energizes the pump, thus substantially preventing the pump from being damaged by pumping under dry sump conditions. In another preferred embodiment, the auxiliary shut-down device such as the float switch is connected to the circuit of the primary pump controller and can shut down the pump controller by opening the primary voltage circuit of the pump controller. This will effectuate a total system shut-down and the auxiliary shut-down device acts as a circuit breaker for the pump controller. In an alternative embodiment, the auxiliary shut-down device such as the float switch can shut down the pump controller by opening a secondary sensing circuit, such as a 12 V sensing circuit, to disable the capacitive sensing circuit of the pump controllers. This embodiment is particularly useful for pump controller systems incorporating a capacitance-based circuit for differentiating between oil and water, such as the Oil Smart® switch sold by See Water Inc.

In yet another embodiment of the present invention, a submersible pump system comprises a pump controller system having a primary pump controller and an auxiliary shut-down device. Preferably, the auxiliary shut-down device is configured to de-energize (shut down) the pump when the presence of fluid is not detected at a predetermined level below the low water (shut off level) of the pump controller. Preferably, the auxiliary shut-down device is interconnected to the circuit controlling the pump controller such that the device triggers the circuit in the circuit controller to shut down the pump if water is detected at the predetermined level.

DETAILED DESCRIPTION OF THE PREFERRED EMBODIMENT

The preferred embodiments of the present invention provide a pump control system having a primary pump controller and an auxiliary control device. The primary pump controller is adapted to switch a pump on or off based on certain preset conditions and the auxiliary control device is adapted to override the primary pump controller in case the pump controller fails to deactivate the pump in accordance with the preset conditions. The auxiliary control device provides the pump control system with a safety shut down, which significantly reduces potential damage to pumps and the system electronics. The pump control systems are particularly suitable for use with submersible pumps located in transformer vaults, elevator shafts, or other locations where a dry sump condition is likely to exist. It will be appreciated that the pump control system of the preferred embodiments can be used in connection with a variety of different pump systems without departing from the scope of the invention.

Figure 1:
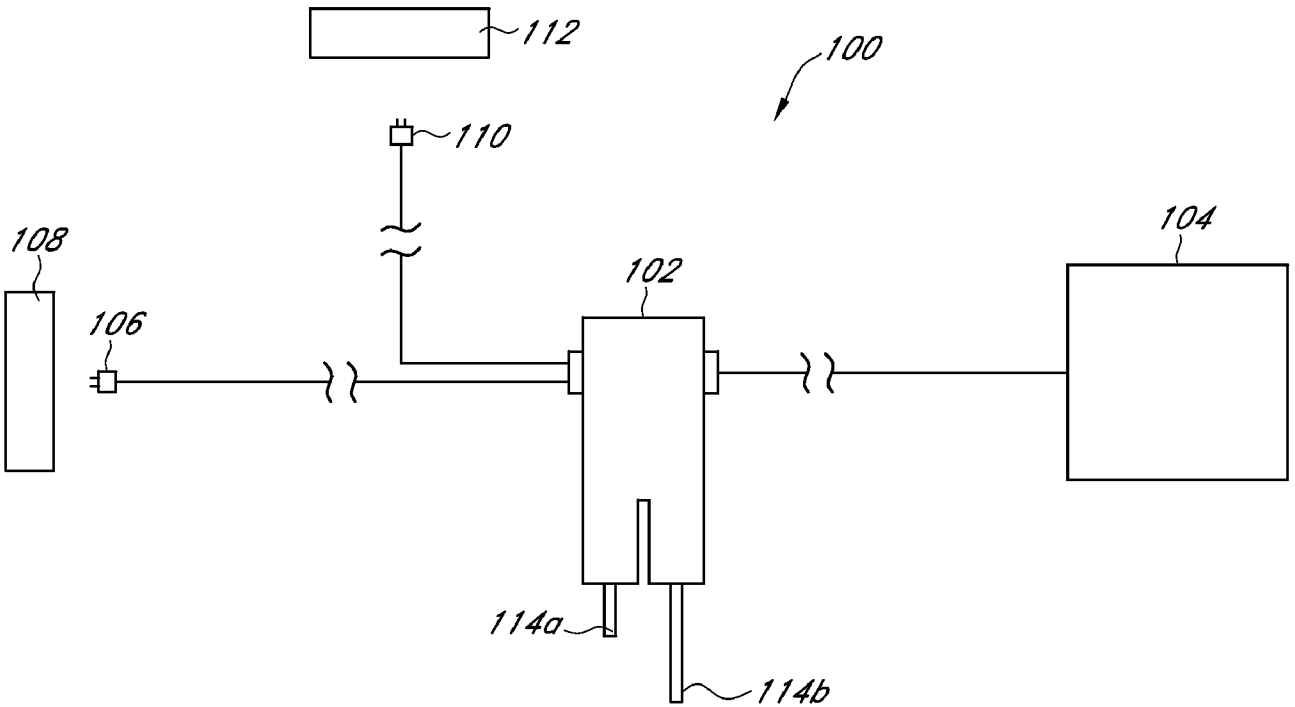
FIG. 1 is a schematic illustration of a pump control system of one preferred embodiment of the present invention.

FIG. 1 illustrates a pump control system 100 of one preferred embodiment of the present invention. As shown in FIG. 1, the pump control system 100 generally includes a primary pump controller 102, an auxiliary control device 104 which is operatively connected to the controller 102, a first interconnect 106 for electrically connecting the system 100 to an external power source 108, and a second interconnect 110 for electrically connecting the system 100 to a pump 112. The primary pump controller 102 is adapted to energize and de-energize the pump 112 so as to turn the pump on and off, preferably under certain preset conditions. In a preferred embodiment, the primary pump controller 102 can be used to operate a submersible pump such as those used to remove water from electrical vaults, elevator shafts, sumps and other confined spaces where water is likely to accumulate. The preset conditions for shutting down the pump can include the occurrence of the water level having reached a low threshold level or that oil is detected in the water. The preset conditions for activating the pump can include the occurrence of the water level having reached a high threshold level and that oil is not detected in the water. The pump controller 102 can incorporate a variety of different types of pump controllers, including those described in U.S. Pat. Nos. 6,203,281, 4,715,785, and 4,752,188, which are incorporated by reference in their entireties.

In a preferred implementation, the primary pump controller 102 is capable of detecting and distinguishing between non-conductive and conductive fluids, such as oil and water. In practice, when water is detected by the primary pump controller 102 at a predetermined level, the primary pump controller activates the pump in a manner know in the art so that the pump could begin removing the water. However, when oil is detected by the primary pump controller 102, the primary pump controller de-energizes and shuts down the pump in a manner known in the art. The primary pump controller 102 can utilize a variety of different sensors and/or probes to distinguish between oil and water, including but not limited to conductivity sensors, dielectric sensors, and/or capacitance based sensors.

In the embodiment shown in FIG. 1, the primary pump controller 102 utilizes a capacitance based sensor to detect the presence of oil or water. As shown in FIG. 1, the pump controller 102 has a pair of capacitive sensors 114*a*, 114*b*, one located above the other. A dual mode frequency oscillator is associated with each sensor such that each sensor reacts to the dielectric constant of the liquid by changing its capacitance, to thus detect the presence of a conductive substance, such as water, or a non-conductive substance, such as oil. The dual mode oscillator of each sensor selectively generates a control signal having two different duty cycles. As the dielectric constant of a liquid medium is sensed, a logic circuit interposed between the sensors allows the output of each sensor to be turned off when only the lower sensor is in water. The circuit turns on the pump only when both sensors are in water and the pump remains on until both sensors are out of water. An adjustable deadband is provided, thereby avoiding having the pump turning on and off with a slight water level change. Each sensor detects the difference between dielectric constants of air and of oil, in relation to that of water. As a result, the primary pump controller 102 differentiates between water and oil and activates the system to pump water while deactivating the system before oil on the water surface is pumped. A more detailed description of the design and operation of the primary pump controller 102 of this embodiment is described in U.S. Pat. No. 5,856,783, which is hereby incorporated by reference in its entirety.

As FIG. 1 further shows, the auxiliary control device 104 of a preferred embodiment comprises a float switch that is operatively interconnected to the primary pump controller 102. The float switch 104 is preferably electrically connected to the pump controller 102 and is adapted to override the pump controller 102 to shut down the pump when water has reached a predetermined low level and yet the pump is still activated.

In one embodiment, the float switch 104 operates as a fluid controlled automatic circuit breaker. When water has fallen below a predetermined low level and yet the pump is still operating, the float switch can be designed to open the primary voltage circuit to the pump controller, thereby effectuating a total shut down of the pump controller, which in turn shuts down the pump. In an alternative embodiment, the float switch can be connected to the pump controller circuit in a manner such that it is used to open a secondary sensing circuit, such as a 12 V sensing circuit, to disable a capacitive based sensing circuit. The auxiliary control device can comprise a float switch, a pressure switch, magnetic reed switch attached to the pump controller or any other types of switch or device that is capable of de-energizing or shutting down the pump controller when water is below a pre-determined level to prevent the pump from pumping in a dry sump. These types of conditions are likely to occur when the sensor circuit of the pump controller fails to operate properly, which can be due to a variety of causes such as contamination and corrosion.

Figure 2:
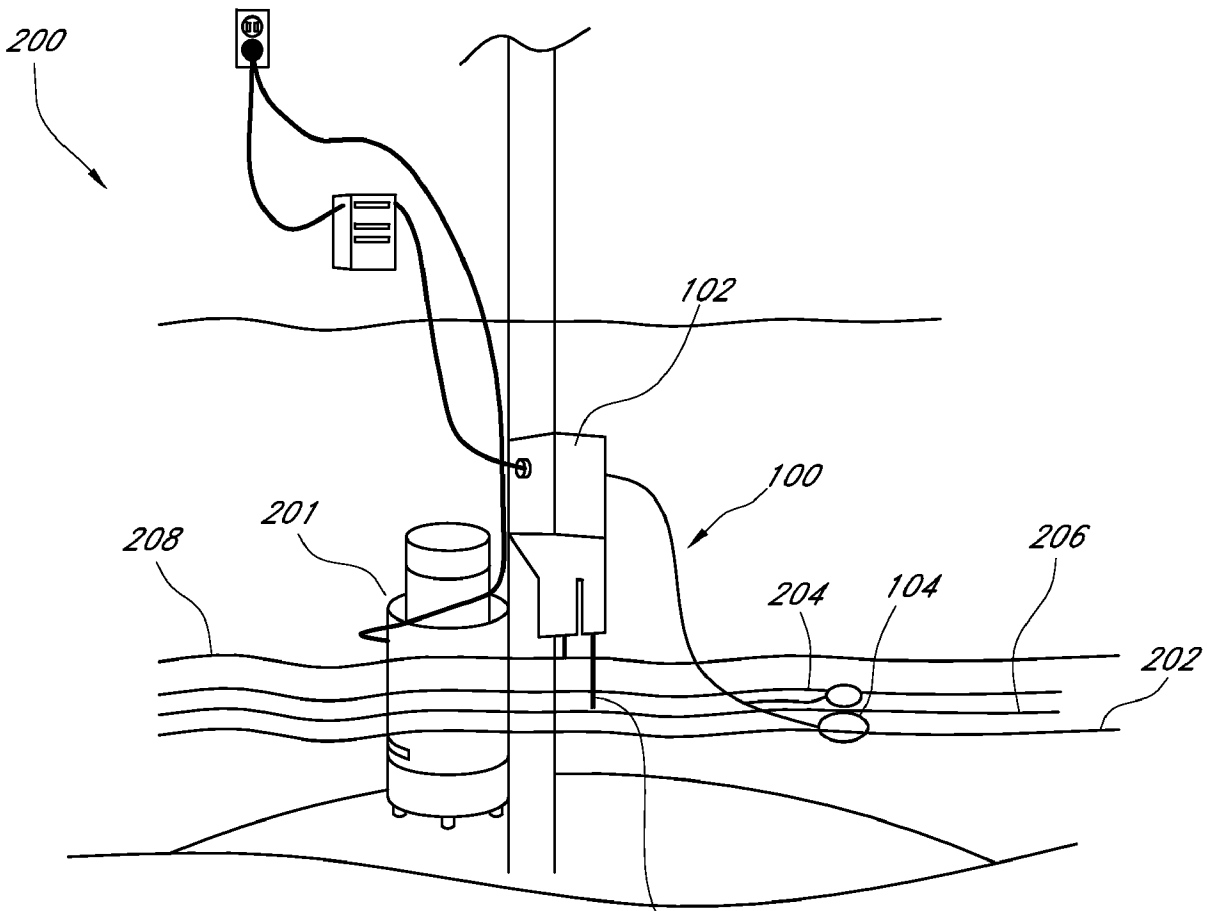
FIG. 2 schematically illustrates a submersible pump system incorporating the pump control system of FIG. 1.

FIG. 2 shows a submersible pump system 200 incorporating the pump control system 100 of FIG. 1. As shown in FIG. 2, the system 200 generally comprises a submersible pump 201 that is operatively connected to the pump control system 100. The pump control system 100 generally comprises a primary pump controller 102 which incorporates a capacitance based oil sensor 114 and an auxiliary control 104 which is a float switch. In operation, the float switch 104 of the pump control system 100 is positioned in a manner so as to detect the presence of water at a predetermined level 202 below the low-water level (pump controller off level) 204 and de-activate or de-energize the pump controller when no water is detected at the predetermined level 202. De-activation of the pump controller when water has fallen below the low-water level substantially reduces pump damage caused by pumping in a dry sump and also provides a safe, energy efficient mode for the pump controller electronics.

In the embodiment shown in FIG. 2, the float switch 104 is positioned in a manner such that its on-position is located at the predetermined level 202 which is below the off level 204 of the primary pump controller 102. When water has reached the predetermined level 202, the float switch 104 will trigger the circuit in the primary pump controller to de-activate the pump 201. This can be done by opening the primary voltage circuit to the pump controller to cut out the voltage source to the pump controller or by opening a secondary sensing circuit to cut out the voltage source to the capacitance based sensor. In certain embodiments, if the water level rises to a second predetermined level 206 after the primary pump controller 102 has been shut down by the float switch 104, the float switch will re-energize the pump controller 102. This can be done by either closing the primary voltage circuit in the pump controller or by closing the secondary sensing circuit in the controller.

In one embodiment, the predetermined "dry-condition" level 202 is pre-set at approximately 4-6 inches below the low water pump controller off level 204. In another embodiment, a second predetermined level 206 is preset at approximately 3 inches above the predetermined "dry condition" level 202 so that in case water in the sump rises again, the float switch can re-energize the primary pump controller 102, which in turn will activate the pump when water has reached a high water pump on level 208.

The preferred embodiments of the present invention provide a back-up system for shutting down the pump controller for submersible pumps, in case the primary pump controller malfunctions and fails to shut down the pump when water has fallen below a low water level. The pump control system of the preferred embodiments advantageously allow for total system shut down when a dry pump condition exists, thereby leaving the electronic system in a safe mode.

Figures 3, 4:
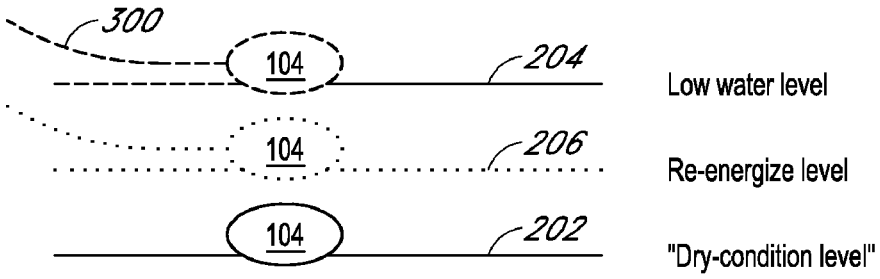
FIG. 3 shows an example operational configuration of various levels that can be implemented for the operation of the auxiliary control system.
FIG. 4 shows an example configuration that can be implemented for the example of FIG. 3.

FIG. 3 shows an example of different liquid levels that can be detected by one or more level detectors of the present teachings. In one embodiment, as described above, the "dry-condition" level 202 can be set at about 4-6 inches below the low water pump controller off level 204. In one embodiment, also as described above, the re-energize level 206 can be set at about 3 inches above the "dry-condition" level 202. Other configurations are also possible.

FIG. 4 shows an example logic table that can reflect the example configuration of FIG. 3. In one embodiment, as described above, when the water level is above the low water level 204, the pump controller can be energized so as to allow pumping. In such a state, the auxiliary control can be energized to allow energization of the pump controller. In one embodiment, as shown in the last row of the table in FIG. 4, when the water level is below the dry-condition level, the auxiliary control can be triggered off, so that the pump is not operational (for example, by de-energizing the pump control).

In one embodiment where the re-energize level (206 in FIG. 3) can be detected, the auxiliary control can be triggered off when the water level is between the dry-condition level 202 and the re-energize level 206. When the water level is between the re-energize level 206 and the low water level 204, the auxiliary control can be triggered on so that the pump controller can be energized, thereby allowing the pump to operate when the water level rises above the low water level 204. Other configurations are possible.

Figure 5:
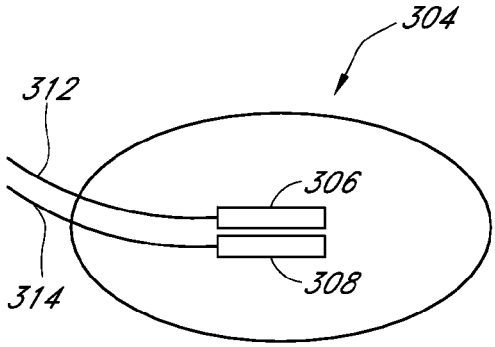
FIG. 5 shows one embodiment of a float device that can be configured to provide the example functionality of FIG. 4.

FIG. 5 shows that in one embodiment, a float 304 can include a primary level switch 306 (with leads 312) and an auxiliary level switch 308 (with leads 314). The primary switch 306 can be used to detect the low water level 204, and the auxiliary switch 308 can be used to detect the dry-condition level 202. One or more additional level switches can be used to detect other level(s) such as the re-energize level 206. In one embodiment, the various levels can be detected using separate level-sensing switches such as mercury switches. In another embodiment, a single switch can be used to detect a plurality of levels. In one embodiment, any combination of the foregoing configurations can be used to detect the various levels of the example float 304.

Figure 6A:
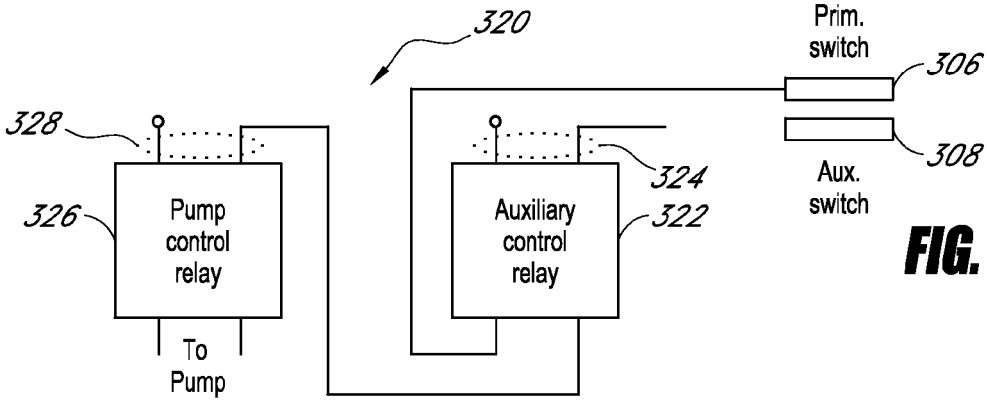
FIGS. 6A-6C show non-limiting example configurations where the auxiliary control can be used to prevent damage to the pump and/or sensor under certain conditions.
Figure 6B:
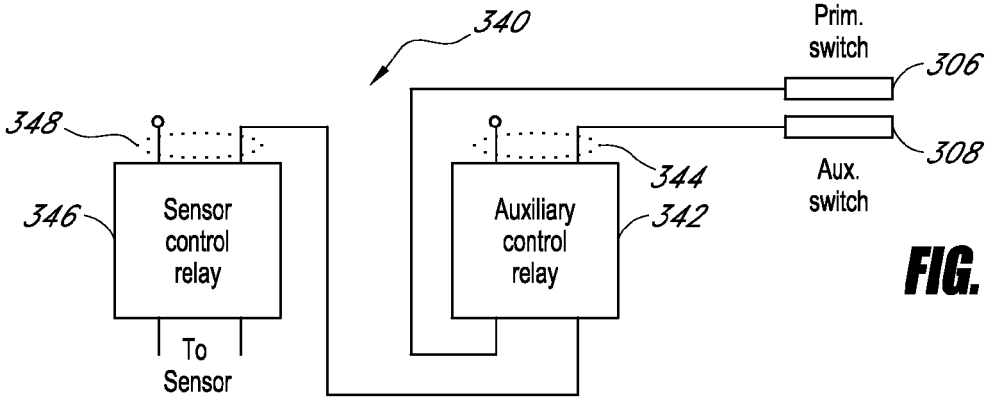
Figure 6C:
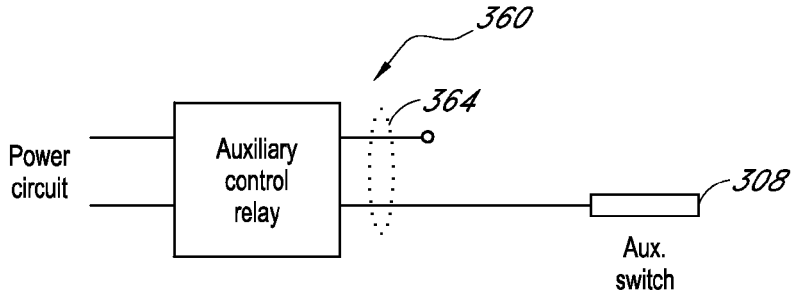

FIGS. 6A-6C show various examples of how the auxiliary level switch can be used to disable the operation of the pump and/or the sensor under certain conditions. For the purpose of description, it will be assumed that the float 304 includes the example primary and auxiliary level switches 306 and 308 set to detect different levels. However, as described above, other level detecting configurations are possible.

FIG. 6A shows that in one embodiment of an example configuration 320, turning on and off of the pump can be facilitated by a pump control relay 326. As shown, an input circuit 328 can energize the pump end of the relay 326, thereby either energizing the de-energizing the pump (not shown). In one embodiment, an auxiliary relay 322 can be coupled to an input circuit 324 that includes the auxiliary switch 308. Thus, the input switch of the relay 322 can be turned on or off by the operation of the auxiliary switch 308. The output of the auxiliary relay 322 is shown to be part of the input circuit 328 for the pump control relay 326. Thus, the pump control relay can be turned on and off by the operation of the primary level switch 306 and the auxiliary relay 322 (which in turn depends on the auxiliary switch 308).

Thus, for example, when the level is below the dry-condition level 202, the auxiliary switch 302 can be in a position such that the output of the auxiliary control relay 322 is open. In such a condition, the pump control input is disabled, thereby disabling the output to the pump.

FIG. 6B shows that in one embodiment of an example configuration 340, turning on and off of the sensor can be facilitated by a sensor control relay 346. As shown, an input circuit 348 can energize the sensor end of the relay 346, thereby either energizing the de-energizing the sensor (not shown). In one embodiment, an auxiliary relay 342 can be coupled to an input circuit 344 that includes the auxiliary switch 308. Thus, the input switch of the relay 342 can be turned on or off by the operation of the auxiliary switch 308. The output of the auxiliary relay 342 is shown to be part of the input circuit 348 for the pump control relay 346. Thus, the pump control relay can be turned on and off by the operation of the primary level switch 306 and the auxiliary relay 342 (which in turn depends on the auxiliary switch 308).

In one embodiment 360, as shown in FIG. 6C, an auxiliary control relay 362 can be provided with an input 364 that includes the auxiliary switch 308. The output of the auxiliary control relay 362 can be coupled to control the power circuit that powers the pump, pump-related components, sensor, and/or sensor-related components. Thus, for example, when the water level goes below the dry-condition level 202, power to the pump and/or sensor related components can be cut off to prevent damage.

In one embodiment, the foregoing relays can be, for example, miniature PCB power relays such as 812H-1C-C type. It will be understood, however, that many other relays and similar devices can be used without departing from the present teachings. Moreover, it will be understood that various other different configurations are possible for implementing the functionality of the auxiliary control.

While the above detailed description has shown, described, and pointed out novel features of the invention as applied to various embodiments, it will be understood that various omissions, substitutions, and changes in the form and details of the device or process illustrated may be made by those skilled in the art without departing from the spirit of the invention. As will be recognized, the present invention may be embodied within a form that does not provide all of the features and benefits set forth herein, as some features may be used or practiced separated from others.

What is claimed is:

1. A pump control system for a submersible pump used to remove water in an enclosed space, comprising:

a pump controller, said pump controller is electrically connected to the submersible pump and capable of activating and deactivating the submersible pump, wherein the pump controller comprises a primary circuit and a secondary sensing circuit, said pump controller is adapted to activate the submersible pump when water has reached a first level in the enclosed space and to deactivate the submersible pump when water has reached a second level that is below the first level, wherein said pump controller incorporates one or more sensing devices that are capable of detecting the presence of a non-conductive fluid in water, wherein said one or more sensing devices comprise one or more capacitance based sensors or one or more conductivity based sensors; and an auxiliary control device, said auxiliary control device is adapted to automatically override the pump controller and deactivate the submersible pump, by de-energizing the pump controller, if the submersible pump remains activated when water reaches a third level in the enclosed space, wherein said third level is below the second level, said auxiliary control device is adapted to automatically re-energize the pump controller by closing the secondary sensing circuit in the pump controller when water rises to the second level after the pump controller has been deactivated by the auxiliary control device.

2. The system of claim 1, wherein the auxiliary control device comprises a float switch.

3. The system of claim 1, wherein the auxiliary control device automatically overrides the pump controller and deactivates the submersible pump by disconnecting the electrical connection between the pump controller and the submersible pump.

4. The system of claim 1, wherein the non-conductive fluid is oil.

5. A method of controlling the operation of a submersible pump in a confined area, comprising:

detecting a first predetermined water level in the confined area;

activating the submersible pump via a pump controller if water level is at or above the first predetermined level;

detecting a second predetermined water level in the confined area, wherein the second predetermined water level is below the first predetermined water level;

deactivating the submersible pump by de-energizing said pump controller if water level is at or below the second predetermined water level;

sensing a third predetermined water level in the confined area, wherein the third predetermined water level is below the second predetermined water level;

overriding the pump controller so as to de-energize the submersible pump if water level is at or below the third predetermined water level and the pump remains activated; and re-energizing the pump controller when water level rises back to the second predetermined water level.

6. The method of claim 5, wherein the submersible pump is de-energized by disconnecting the electrical connection between the pump and pump controller.

* * * * *